United States Patent [19]

Fox et al.

[11] Patent Number: 4,595,041

[45] Date of Patent: Jun. 17, 1986

[54] PORTABLE LOG PEELING APPARATUS HAVING A DRAW KNIFE

[75] Inventors: Robert A. Fox, 6601 Locus Rd., Pleasant Grove, Calif. 95668; Clifford D. Hyatt, Auburn, Calif.

[73] Assignee: Robert A. Fox, Pleasant Grove, Calif.

[21] Appl. No.: 635,667

[22] Filed: Jul. 30, 1984

[51] Int. Cl.[4] ..... B27L 1/06

[52] U.S. Cl. ..... 144/208 D; 144/208 H; 144/208 G; 144/115; 30/169

[58] Field of Search ..... 30/169, 170; 144/208 R, 144/208 C, 208 G, 208 H, 208 D, 208 J, 115, 121, 340, 341

[56] References Cited

U.S. PATENT DOCUMENTS

| | | | |
|---|---|---|---|
| 1,937,073 | 11/1933 | Stüve | 144/208 H |
| 2,197,154 | 4/1940 | Miller | 30/170 |
| 2,660,207 | 11/1953 | Phillips | 144/208 |
| 2,672,899 | 3/1954 | Kafka | 144/208 H |
| 2,676,628 | 4/1954 | Hastain | 144/208 H |
| 2,705,982 | 4/1955 | Ponts | 144/208 C |
| 2,802,497 | 8/1955 | Yeadon | 144/208 E |
| 3,037,537 | 6/1962 | Romer | 144/208 H |
| 3,122,832 | 3/1964 | Dale | 30/169 |
| 3,477,482 | 11/1969 | Heilig et al. | 144/208 R |
| 4,452,492 | 6/1984 | Grasse | 30/169 |

*Primary Examiner*—W. D. Bray
*Assistant Examiner*—Jorji M. Griffin
*Attorney, Agent, or Firm*—Lee W. Tower

[57] ABSTRACT

Portable apparatus for peeling logs has a powered draw knife mounted on a frame. The draw knife is swivably mounted on a cutter fork attached to a cutter rod, which is slidably mounted in a hydraulically or pneumatically powered cylinder. A cutter cradle attached to a slide bar on the frame allows an operator to optimally position the draw knife for each stroke. The frame is clamped to the log by a hydraulically or pneumatically powered clamp. The controls for operation of the draw knife are interlocked with the clamp controls for safety.

6 Claims, 9 Drawing Figures

PORTABLE LOG PEELING APPARATUS HAVING A DRAW KNIFE

BACKGROUND OF THE INVENTION

1. Field of the Invention

The present invention generally relates to log peeling apparatus and, more particularly, is concerned with a portable log peeling apparatus having a draw knife and designed to provide a hand hewn finish to a log peeled with the apparatus.

2. Description of the Prior Art

In recent years there has been a substantial increase in the construction of log cabins and homes in mountain areas. The demand for the log homes is a result of their beauty, longevity and natural insulation properties. The latter is especially important in freezing and subfreezing mountain weather. The construction of a log home is a demanding task, due to the raw state of the construction materials. The first steps in building a log home are to select and dry the logs and then to peel the bark off the logs. If a hand hewn look to a log home is desired, then it is necessary to peel the bark off the logs in a manner that results in a relatively smooth surface along the natural contour of the log. A method of peeling a log that would leave gouges or grooves in the log would substantially detract from the beauty of a log home. The desire to reduce the amount of labor required to properly peel the logs has created the need for a powered log peeling apparatus.

Currently hand hewn logs are attained by manually peeling logs with a draw knife. A draw knife is designed with a handle on each end of a blade with a bevel on one edge. A person operates a manual draw knife by straddling a felled log, placing the draw knife on the log with the bevel on the blade facing the log, and then dragging the draw knife along the log. The blade of the draw knife cuts through the bark and cambium layers of wood. The dragging action pulls the draw knife blade along the top of the hard layers of wood leaving them intact. The result is a relatively smooth peeled surface along the contour of the log. This method of attaining a hand hewn log is very labor intensive, too time consuming, and not economical.

Other methods of peeling logs are described in U.S. Pat. Nos. 1,937,073, 2,672,899, 2,676,628, 2,705,982, 2,802,497, and 3,037,537 issued to Stove, Kafka, Hastain, Ponts, Yeadon, and Romer, respectively. The Stove patent describes a disbarking machine that operates by mounting disbarking tools on a chain that travels across the trunk on guide means riding on the trunk. While the Stove invention speeds the peeling of a log, it results in grooves around the peeled log and an appearance that is unacceptable for a log home.

The Kafka invention describes the use of a prime mover to drive an eccentric, which in turn causes a reciprocation of a blade assembly slidably mounted on a frame. The disadvantage of the Kafka design is that it does not result in a hand hewn effect for the peeled log. Another disadvantage of the Kafka design is the rigid manner in which the blade is mounted in the frame, which results in little flexibility in peeling an uneven log.

The Hastain invention uses a chain saw motor and an eccentric to reciprocate a chisel type cutting tool. The disadvantage of this design is that the use of a chisel results in unacceptable grooves on a peeled log.

The Ponts invention uses a pneumatic hammer to reciprocate a chisel. This invention has the same disadvantage as the Hastain design.

The Yeadon invention is quite complex and is not designed to achieve a hand hewn appearance for a peeled log. Furthermore the Yeadon design is not portable.

The Romer invention uses a steel band driven in a reciprocating movement. The reciprocating movement is provided by either a electric motor or an internal combustion engine and is counterbalanced to minimize vibration. The steel band is mounted in a double arm such that one end of the steel band is movably mounted so that it can be adjusted longitudinally during operation to the shape of the log being peeled. A disadvantage of Romer is the constant reciprocating motion caused by the use of a motor, which does not give the operator control of each stroke of the peeling tool. This can result in a ragged peeling of the log. Another disadvantage is that the steel blade is effectively pushed rather than pulled in the manner of a draw knife. This can result in the steel band digging into the log instead of drawing along the cambium layer as a draw knife does. Also as described in the Romer patent the steel band is provided with a bevel on its leading top edge, while a draw knife has the bevel on its leading bottom edge. The latter difference is a key reason why a draw knife provides a smooth hand hewn appearance, while other disbarking tools result in a less satisfactory appearance.

Due to the unsatisfactory operation and appearance of the logs peeled using the prior state of art log peelers, a need exists for a new design for a log peeler which will be portable, provide a hand hewn appearance for a peeled log, and be easy to operate.

Summary of the Invention

The present invention provides a portable log peeling apparatus having a draw knife designed to satisfy the aforementioned needs. The apparatus is designed to simulate the hand finished draw knife look of a log after a person has used a draw knife to peel the bark and the first cambium layers of wood off a log. The apparatus basically consists of a frame, a clamping mechanism, a cutter cradle, a cutter cylinder, a cutter piston rod, a cutter fork, a draw knife, and a means for driving the cutter piston rod, which is either pneumatically or hydraulically powered. The frame can be firmly clamped to a log by the clamping mechanism, which can be pneumatically or hydraulically controlled and powered. A cutter cylinder is mounted onto the frame via a cutter cradle. The cutter cradle is mounted on a horizontal bar on the frame and can slide along this bar. The cutter cylinder can also swing radially around the bar and, via a pivot mount, the cutter cylinder can swing in a horizontal plane with respect to the bar on the frame. From the cutter cylinder, a cutter piston rod extends. The cutter fork is mounted on the cutter piston rod and provides the mounting mechanism for the draw knife. An interlock is provided so that the drawknife cannot be extended unless the clamping mechanism is activated.

Once the frame is properly mounted on a log, the draw knife is first positioned so that it is on a portion of the log to be peeled. Then the operator activates a switch for supplying compressed air or hydraulics to the cutter cylinder thereby extending the draw knife. The draw knife is a "U" shaped blade held between two prongs of the cutter fork. The blade cuts through the bark, softwood, and down into the harder wood. The dragging effect causes the "U" shaped draw knife with its bevel on the edge facing the log, to swing up and out of the hardwood areas. After a stroke of the draw knife, the operator deactivates the switch and the draw knife is retracted and is ready for the next stroke. An operator can peel up to one half of the way around a log before rolling the log by using the flexibility of the cutter cradle to position the draw knife for each stroke. Once an area is peeled, the clamping mechanism can be released and the apparatus moved along the log to an unpeeled area and the process repeated.

DESCRIPTION OF THE PREFERRED EMBODIMENT

Figure 1:
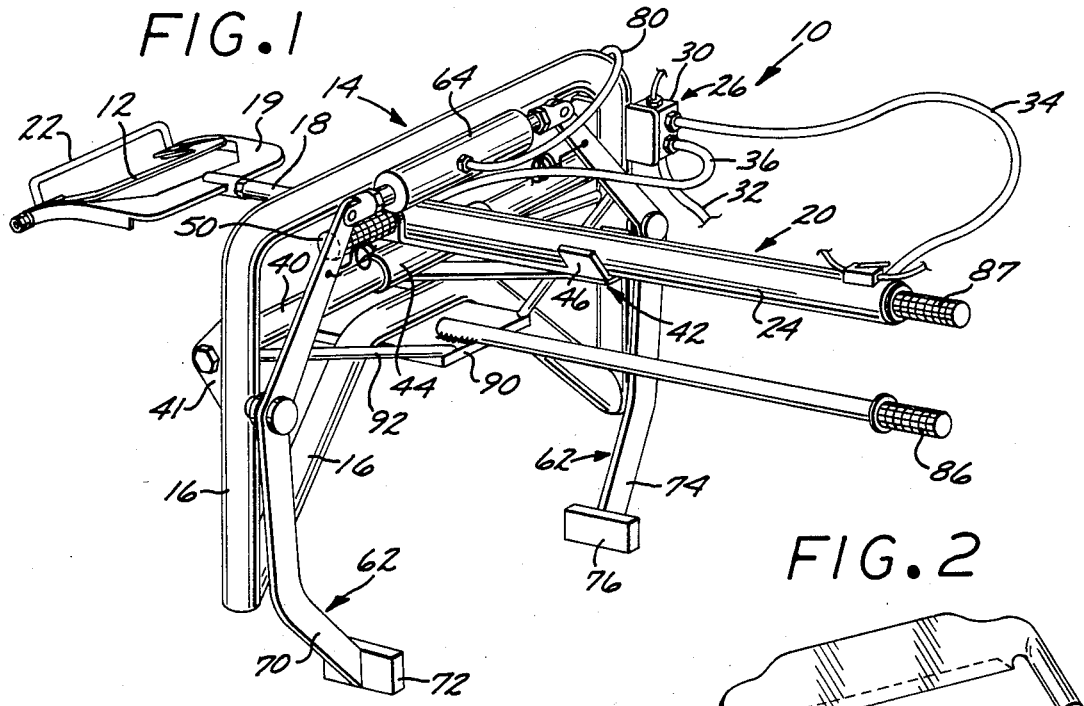
FIG. 1 is a perspective view of the preferred embodiment of the portable log peeling apparatus having a draw knife of the present invention.
Figure 3:
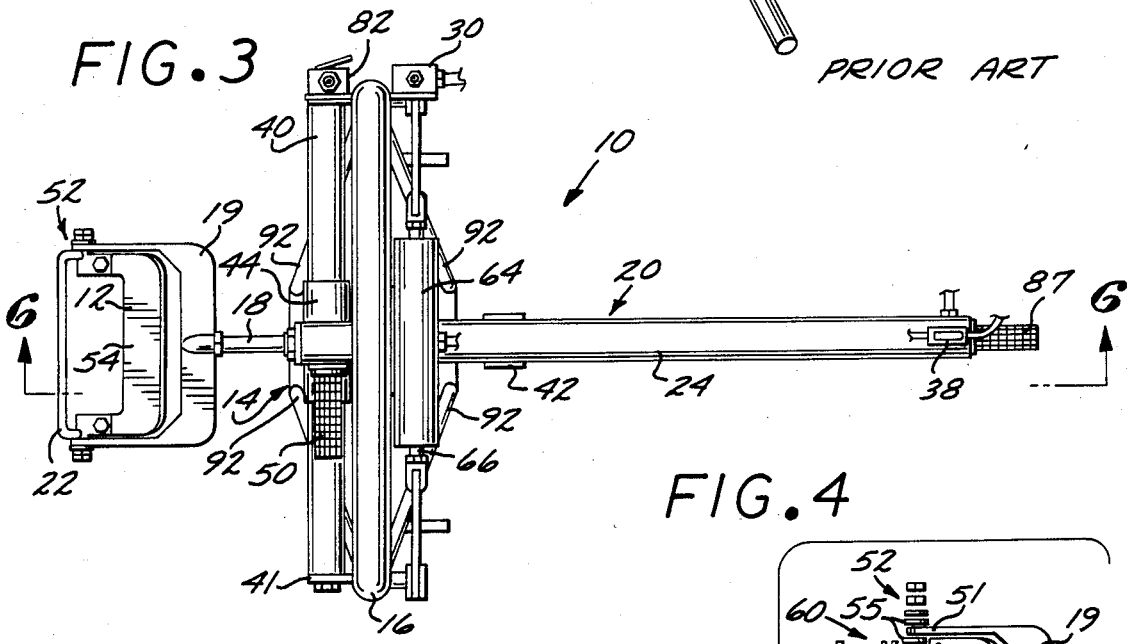
PRIOR ART FIG. 3
FIG. 3 is a top elevational view of the portable log peeling apparatus having a draw knife.

Referring now to the drawings, and more particularly, to FIGS. 1 and 3, there is shown a portable log peeling apparatus, generally designated 10, which comprises the preferred embodiment of the present invention. The apparatus 10 basically includes a draw knife 12 and means 14 for driving the draw knife. Again referring to FIGS. 1 and 3, means 14 for driving the draw knife principally includes frame 16, cutter fork 19, and means 20 for driving cutter fork 19.

In the preferred embodiment of the apparatus 10 shown in FIGS. 1 and 3, means 20 for driving cutter fork 19 includes a cutter rod 18, a cutter cylinder 24 with the cutter rod slidably mounted therein, and an air circuit means 26 for providing air to the cutter cylinder 24 in order to control the movement of cutter rod 18. The air circuit means 26 shown in FIG. 9 includes a power source such as compressed air source 28, a piston air valve 30, a first air hose 32 connected from the compressed air source 28 to the piston air valve 30, a second air hose 34 connected from the piston air valve 30 to cutter cylinder 24 for providing air to drive the cutter rod 18 out of the cutter cylinder 24, a third air hose 36 connected from piston air valve 30 to cutter cylinder 24 for providing air to retract cutter rod 18 into cutter cylinder 24, and a two position piston valve switch 38 for controlling the piston air valve. When piston valve switch 38 is activated, compressed air is directed from the compressed air source 28 to the second air hose 34 and exhausted from the third air hose 36 thereby providing air to one end of the pneumatic cutter cylinder 24 and driving the cutter rod 18 so that it extends from the cutter cylinder 24. When the piston valve switch 38 is deactivated, compressed air is directed from the compressed air source 28 to the third air hose 36 and exhausted from the second air hose 34 thereby providing air to the other end of the pneumatic cutter cylinder 24 and retracting cutter rod 18 into the cutter cylinder 24.

Figure 5:
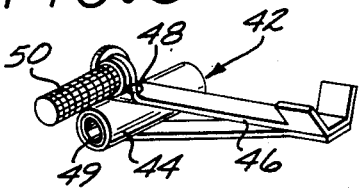
FIG. 5 is a perspective view of the cutter cradle of FIG. 1 and FIG. 2.
Figure 6:
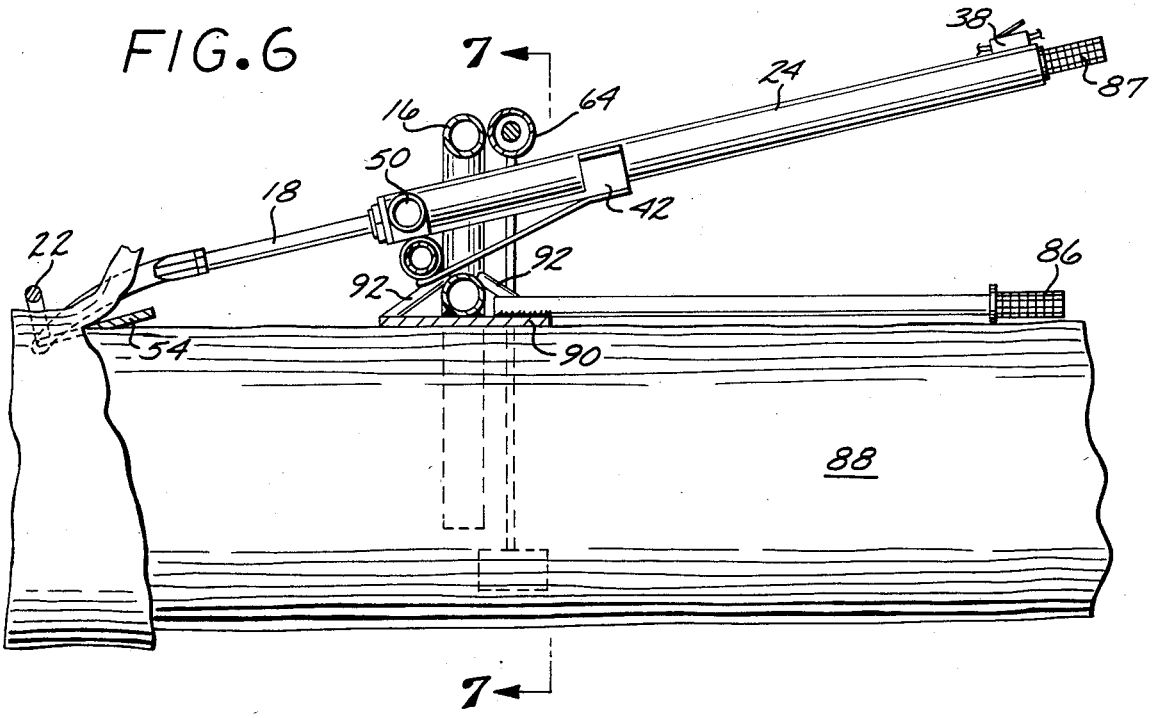
FIG. 6 is a side elevation sectional view along the line 6—6 on FIG. 3 showing the mounting of the apparatus on a log.

Cutter cylinder 24 is mounted onto cutter cradle 42 shown in FIGS. 1, 3 and 6 and shown in detail in FIG. 5. The cutter cradle is mounted on slide bar 40, which is bolted onto flange 41 welded on frame 16 as shown in FIGS. 1 and 3. The cutter cradle 42, as shown in FIG. 5, includes a cutter cradle cylinder 44, which is slidably mounted on slide bar 40 as shown in FIGS. 1 and 3, and a cutter cradle bracket 46, which is pivotally mounted on the cutter cradle cylinder 44. This arrangement allows the cutter cradle 42 to be slid along the slide bar 40 as well as rotated about the slide bar 40. A teflon bushing 49 inside the cutter cradle cylinder 44 assures that the cutter cradle 42 will not bind on the slide bar 40. The cutter cradle pivot 48 shown in FIG. 5 allows the cutter cradle bracket 46 to pivot with respect to the cutter cradle cylinder 44. This mounting arrangement for the cutter cylinder 24 allows the operator to optimally position the draw knife 12 for each peeling stroke.

Figure 4:
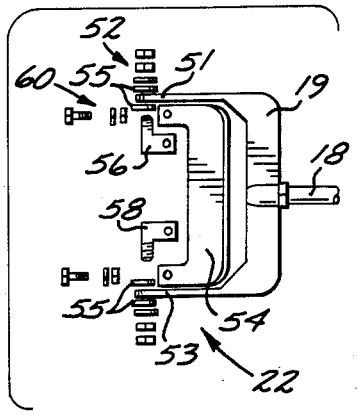
FIG. 4 is a top elevational view of the swivel draw knife and cutter fork of FIG. 1 and FIG. 2 showing the dissembled draw knife blade, mounting brackets, and cutter fork.

As shown in FIG. 4, cutter fork 19 has a first prong 51 and second prong 53, and means 52 for swivel mounting draw knife 12 on first prong 51 and second prong 53 of the cutter fork 19. The draw knife 12, shown in FIG. 1 and 3, is further comprised of blade 54 having a bevel on one edge. In operation of the log peeling apparatus, the edge of the blade with the bevel faces the log so that the draw knife cuts only into the soft cambium layers of the log and lifts up out of the harder inner layers of wood thereby peeling the bark off the log. The blade 54 is mounted to mounting brackets 56 and 58 using the bolts, nuts and washers designated as 60; furthermore, the mounting holes in blade 54 are threaded. The mounting brackets 56 and 58 are attached to prongs 51 and 53 using the bolts, nuts and washers designated 52 and 55. Washers 55 are teflon washers to allow the draw knife 12 to swivel up and down in the cutter fork 19. The tension on the swivel mounting of the draw knife 12 to the cutter fork 19 can be adjusted so that for operation on hard logs, chattering of the draw knife can be eliminated. Chattering is the phenomenon of the draw knife 12 cutting into the log and lifting out of the log in a rapid repeated manner during a stroke. The tension of the mounting is adjusted by tightening the bolts, nuts, and washers 52 and 55. As a safety feature, guard 22, shown in FIGS. 1 and 3, is mounted on the front of cutter fork 19.

Figure 7:
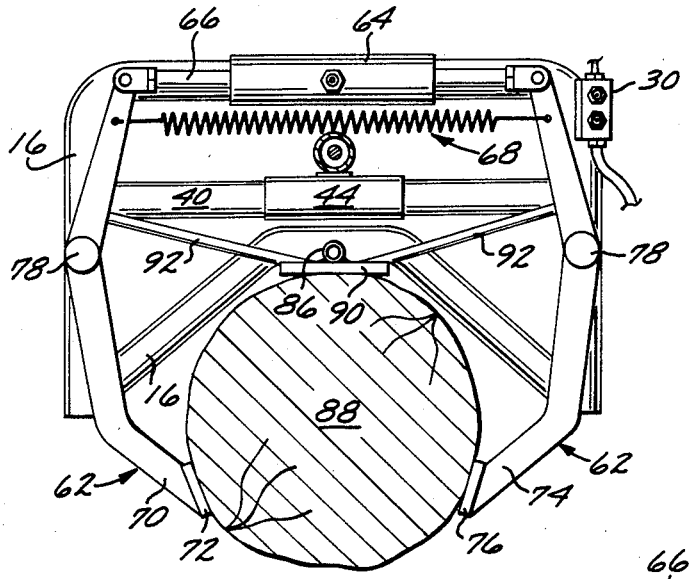
FIG. 7 is a sectional view along the line 7—7 on FIG. 6.

Means 62 for firmly attaching the frame 16 to log are shown in FIGS. 1 and 7. Means 62 is comprised of clamp cylinder 64, clamp piston 66 slidably mounted in the clamp cylinder, clamp piston return spring 68, first clamp arm 70 swivably mounted at pivot 78 on frame 16 and having first clamp shoe 72, and second clamp arm 74 swivably mounted at pivot 78 on frame 16 and having second clamp shoe 76.

Figure 9:
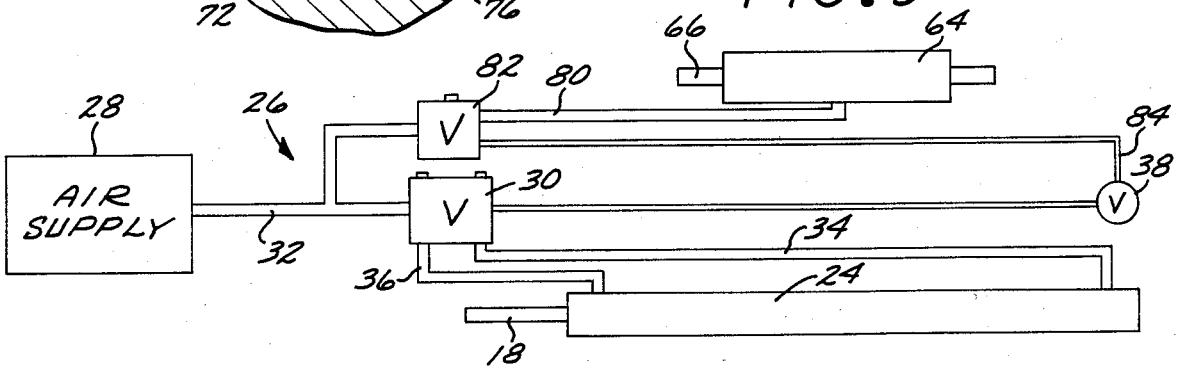
FIG. 9 is an air circuit schematic for the apparatus.

Operation of the means 62 is pneumatic. As shown in FIG. 9 a fourth air hose 80 is connected from second piston valve 82 to clamp cylinder 64. When the second piston valve 82 is activated, compressed air is directed from compressed air source 28 to clamp cylinder 64 via first air hose 32 and fourth air hose 80 thereby forcing the clamp piston 66 out of the clamp cylinder. When the second piston valve 82 is deactivated, compressed air is exhausted from the clamp cylinder 64 via fourth air hose 80 and clamp piston 66 is retracted into the clamp cylinder 64 by clamp piston return spring 68. When the clamp piston is extended, the first and second clamp arms 70 and 74 pivot at pivot 78 thereby clamping first and second clamp shoes 72 and 76 on a log 88 as shown in FIG. 7.

An interlock means 84 shown in FIG. 9 is provided for safety. It prevents operation of the cutter cylinder 24 unless the second piston valve 82 that operates the clamp cylinder is activated. This is a reminder to the operator of the log peeling apparatus to firmly attach the frame to the log before beginning the peeling operation. Means 84 functions by providing compressed air to the two position piston valve switch 38 when the second piston valve 82 is activated. Without this compressed air, valve switch 38 is inoperable.

As shown in FIG. 6 and 7, the apparatus rests on top of a log 88 on plate 90 which is welded onto frame 16 and supported by braces 92. A frame handle 86 is welded onto plate 90 and a front handle 50 is welded onto the cutter cradle 42 as shown in FIG. 5. During operation, the operator grips the front handle 50 with one hand, and a rear handle 87 with the other hand. Then the operator can position the draw knife 12 for each stroke. When moving the log peeling apparatus to a new position, the operator tilts back the cutter cylinder 24 and grips rear handle 87 and frame handle 86 with one hand and frame 16 with the other hand and then lifts the entire apparatus.

Figure 2:
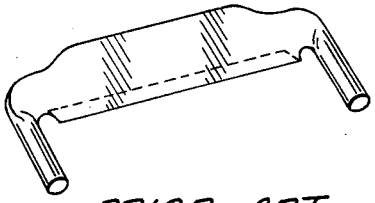
FIG. 2 is a perspective view of a manual draw knife of the prior art.
Figure 8:
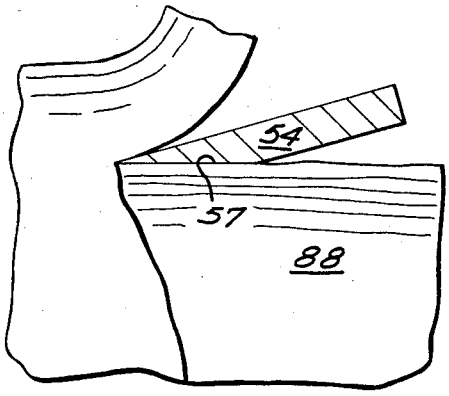
FIG. 8 is an enlarged detail of the draw knife bevel as it contacts the log in FIG. 6.

FIGS. 6 and 8 show the detail of how the bevel 57 of blade 54 engages the log 88. As shown, the bevel 57 faces the log 88. When the draw knife 12 is pulled by the cutter fork 19 along the log, the blade 54 cuts through the bark and cambium layers of wood, peeling them away from the log. The bevel 57 lifts the blade out of the hard layers of wood. The overall effect is the same as that obtained using the prior art manually operated draw knife shown in FIG. 2.

It is thought that the portable log peeling apparatus having a draw knife of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof. For example, another embodiment that is very similar to the form hereinbefore described is one that is hydraulically controlled and operated instead of pneumatically controlled and operated.

We claim:

1. An apparatus for providing peeled logs with a hand hewn finish suitable for log houses that includes a frame, a means connected to said frame for firmly attaching said frame to a log, a drive means carried on said frame, a cutter fork having two prongs connected to said drive means and driven by said drive means, a draw knife swivel mounted between said two prongs of said cutter fork, the improvement comprising:

(a) a round slide bar mounted horizontally on said frame; and (b) a cradle cylinder slidably mounted on said round slide bar; and (c) a cradle bracket pivotally mounted on said cradle cylinder for carrying said drive means whereby said draw knife driven by said drive means can be optimally positioned on a log for each stroke.

2. Log peeling means as recited in claim 1 wherein said drive means comprises:

(a) a power source for supplying pressurized fluid; and (b) a cutter cylinder attached to said cradle bracket; and (c) a cutter rod attached to said cutter fork and slidably mounted in said cutter cylinder; and (d) a first hose connected from said power source to said cutter cylinder; and (e) a second hose connected from said power source to said cutter cylinder; and (f) a first bipolar switch connected to said power source for controlling said power source wherein when said first bipolar switch is in one position said pressurized fluid is directed to said first hose and said cutter rod is extended out of said cutter cylinder and wherein when said first bipolar switch is in the other position said pressurized fluid is directed to said second hose and said cutter rod is retracted into said cutter cylinder.

3. Log peeling means as recited in claim 2 wherein said means for firmly attaching said frame to a log comprises:

(a) a first clamp arm pivotally mounted on said frame; and (b) a second clamp arm pivotally mounted on said frame; and (c) a clamp cylinder connected to said first clamp arm above the pivot mount of said first clamp arm and to said second clamp arm above the pivot mount of said second clamp arm; and (d) a third hose connected from said power source to said clamp cylinder for providing pressurized fluid to said clamp cylinder; and (e) a second bipolar switch mounted on said frame controlling said power source wherein when said second bipolar switch is in an activated position said pressurized fluid is directed from said power source to said clamp cylinder via said third hose and said clamp cylinder longitudinally expands clamping the first and second clamp arms on a log and wherein when said second bipolar switch is in an unactivated position said pressurized fluid is directed from said clamp cylinder and said first and second clamp arms are released from a log; and (f) an interlock means connected between said first bipolar switch and said second bipolar switch that operates such that when said second bipolar switch is in said unactivated position said first bipolar switch is inoperable and said cutter fork can not be driven by said drive means.

4. Log peeling means as recited in claim 3 wherein said draw knife further comprises:

(a) a blade having a bevel only on the lower edge.

5. An apparatus for peeling a log with a hand hewn finish comprising:

(a) a frame; and (b) a round slide bar mounted on said frame: and (c) a cradle cylinder slidably mounted on said round slide bar; and (d) a cradle bracket pivotally mounted on said cradle cylinder; and (e) a cutter cylinder mounted on said cradle bracket; and (f) a cutter rod slidably mounted in said cutter cylinder; and (g) a cutter fork having two prongs connected to said cutter rod; and (h) a draw knife swivel mounted between said two prongs of said cutter fork; and (i) a power means connected to said cutter cylinder for driving said cutter rod alternately in and out of said cutter cylinder; and (j) control means associated with said power means for controlling said driving of said cutter rod in and out of said cutter cylinder; and (k) means connected to said frame for firmly attaching said frame to a log.

6. An apparatus for peeling a log with a hand hewn finish comprising:

(a) a frame; and (b) a means connected to said frame for firmly attaching said frame to a log; and (c) a round slide bar mounted horizontally on said frame; and (d) a cradle cylinder slidably mounted on said round slide bar; and (e) a cradle bracket pivotally mounted on said cradle cylinder; and (f) a drive means attached to said cradle bracket; and (g) a control means for controlling said drive means associated with said drive means; and (h) a cutter fork having two prongs connected to said drive means and driven alternately back and forth by said drive means under control of said control means; and (i) a draw knife swivel mounted between said two prongs of said cutter fork.

* * * * *